United States Patent [19]

Walker

[11] 4,442,927

[45] Apr. 17, 1984

[54] CARRIER FOR GARMENT BAGS AND THE LIKE

[76] Inventor: Brooks Walker, 1280 Columbus Ave., San Francisco, Calif. 94133

[21] Appl. No.: 370,855

[22] Filed: Apr. 22, 1982

[51] Int. Cl.[3] ..... A45C 5/14; A45C 13/04

[52] U.S. Cl. ..... 190/18 A; 190/123; 206/287.1; 280/47.17

[58] Field of Search ..... 190/18 R, 18 A, 43, 190/41 B, 49, 123 (U.S. only); 280/DIG. 3, 47.13 R, 47.17, 47.26, 37; 206/287, 287.1

[56] References Cited

U.S. PATENT DOCUMENTS

| | | | |
|---|---|---|---|
| 1,635,423 | 7/1927 | Lapham | 280/DIG. 3 |
| 2,086,895 | 7/1937 | Cart | 190/41 B X |
| 2,313,547 | 3/1943 | Hinson | 190/43 |
| 2,742,319 | 4/1956 | Tobin | 280/47.13 R X |
| 2,754,945 | 7/1956 | Kish, Jr. | 190/43 |
| 3,139,165 | 6/1964 | Taussig | 190/41 B X |
| 3,299,997 | 1/1967 | Herz | 190/43 |
| 3,989,128 | 11/1976 | Walker | 190/18 A |
| 4,062,429 | 12/1977 | Tabor et al. | 190/18 A |

FOREIGN PATENT DOCUMENTS

| | | | |
|---|---|---|---|
| 544391 | 1/1956 | Belgium | 190/49 |
| 1965036 | 7/1971 | Fed. Rep. of Germany | 190/18 A |
| 1130119 | 1/1957 | France | 190/41 B |
| 1176502 | 4/1959 | France | 190/41 B |

*Primary Examiner*—William Price
*Assistant Examiner*—Sue A. Weaver
*Attorney, Agent, or Firm*—Flehr, Hohbach, Test, Albritton & Herbert

[57] ABSTRACT

A carrier for use with a folded garment carry-on bag includes a stiffening frame within the lower half of the bag. The longitudinally extending frame members extend through the bottom wall of the bag and are provided with horizontal terminal portions on which the ground wheels are rotatably supported, thus obviating an external axle and permitting the ground wheels to be placed inwardly of the longitudinal side edges of the bag.

2 Claims, 7 Drawing Figures

CARRIER FOR GARMENT BAGS AND THE LIKE

This application relates to a wheeled carrier for garment bags and is somewhat similar to that disclosed in my copending application Ser. No. 340,280 filed Feb. 8, 1982, U.S. Pat. No. 4,411,344.

The main object of the present invention is the provision of certain advantages over the carrier disclosed in the above noted application.

More specifically, the present invention provides a stiffening frame and wheel mounting structure that is extremely simple and lends itself to inexpensive manufacture.

Other objects and advantages will be apparent from the following specification and drawings.

Figure 1:
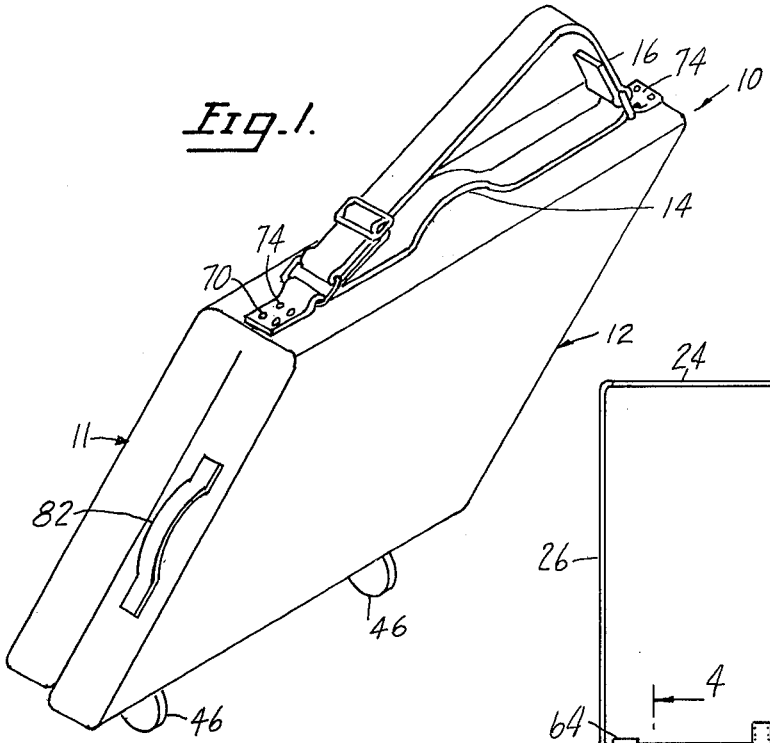
FIG. 1 is an isometric drawing of a wheeled garment bag incorporating the invention.

In FIG. 1 a conventional garment bag formed of textile material is generally designated 10 and having a top half 11 and a bottom half 12 and folded over to permit carrying the same by either a handle 14 or a shoulder strap 16.

Figure 2:
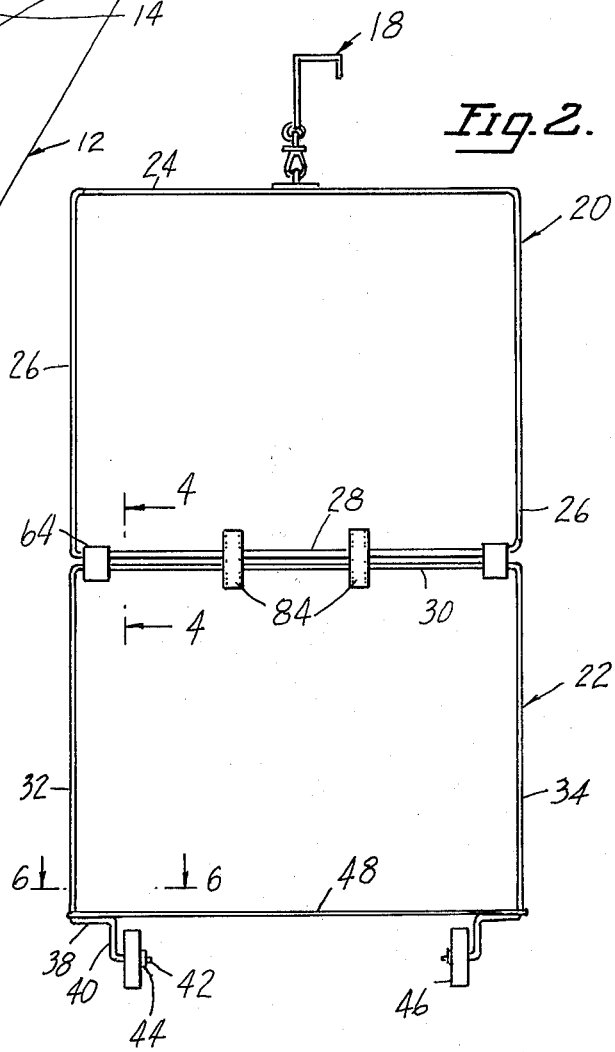
FIG. 2 is a side elevation of the unfolded frame of the garment bag.

In FIG. 2 the interior frame of the same garment bag is shown in its unfolded condition with the top of the garment bag provided with a hook structure generally designated 18 similar to that disclosed in the above noted copending application.

The interior stiffening of the garment bag shown in FIG. 2 comprises two generally rectangular frames—an upper frame generally designated 20 and a lower frame generally designated 22.

The upper frame, which is preferably formed from a unitary length of light weight spring steel rod, includes an upper transverse member 24 to which the hook structure 18 is secured, a pair of longitudinally extending side members 26 alongside the longitudinally extending side edges of top half 11 of the bag, and a second transversely extending member 28 adjacent the central transversely extending fold line of the bag.

Figure 5:
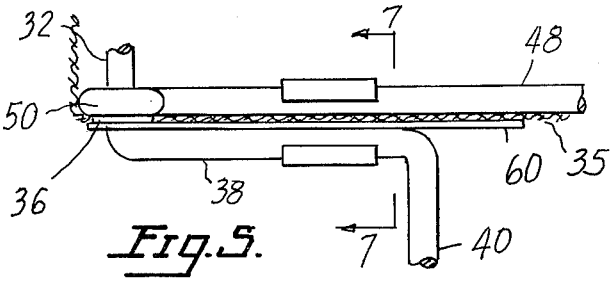
FIG. 5 is a greatly enlarged vertical section of a corner portion of the bag.

The lower frame 22 includes a transversely extending member 30 and longitudinally extending side members 32, 34. As best seen in FIG. 5 the bottom wall 35 of the bag is apertured and preferably provided with a grommet 36 through which each side member extends. The interior portion of the lower end of side member 32 is bent to provide an inwardly extending horizontal portion 38, a vertically extending portion 40, and a horizontally extending terminal portion 42 (FIG. 2) on which a ground wheel 46 is rotatably supported. The free end of terminal portion 42 may be threaded to receive thereon a nut 44 to hold the wheel 46 in place.

As best seen in FIG. 2 the opposite side member 34 is similarly shaped except to the opposite hand.

It will be seen that the above described structure obviates an external axle and at the same time provides a simple means for spacing the ground wheels inwardly from the longitudinally extending side edges of the bag thus minimizing interference with adjacent objects.

Figure 6:
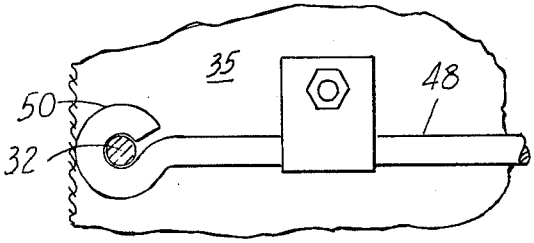
FIG. 6 is a plan view of the structure of FIG. 5.

In order to stiffen the bottom portion of the garment bag a transversely extending lower member 48 is provided with its ends each formed to provide an eye 50 (FIG. 6) for receiving the side members 32, 34 therethrough. If desired, at assembly, said eyes 50 may be crimped to fixedly secure them to said side members.

Figure 7:
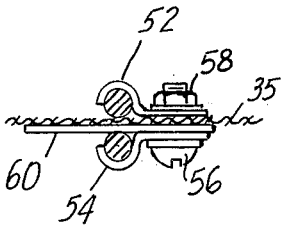
FIG. 7 is a cross section taken in a plane indicated by lines 7—7 of FIG. 5.

As best seen in FIG. 7 the bottom 35 of the garment bag, the transverse member 48 and horizontally extending portion 38 of the side member are secured together by means of a pair of inner and outer clips 52, 54 which are clamped together by means of screw 56 and nut 58. Preferably a short rectangular plate 60 is provided on the outer side of bottom wall 35 to assist in this clamping procedure.

At this point it should be noted that the herein described structure permits the elimination of the usual transversely extending flat bars that have heretofore been employed to stiffen the top wall, the central portion at the fold line, and the bottom wall of the bag.

Figure 3:
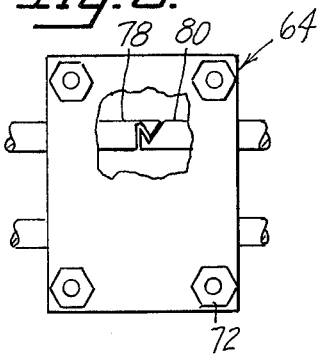
FIG. 3 is a plan view of a bearing pad for the frame members.
Figure 4:
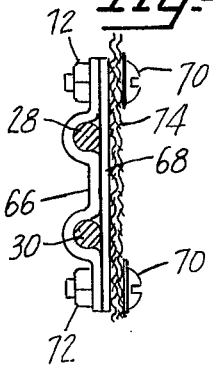
FIG. 4 is a side elevation of the bearing pad of FIG. 3.

In order to provide a hinge connection at the fold line of the garment bag a pair of bearing pads 64 are provided near the longitudinal sides of the garment bag. As best seen in FIGS. 3, 4 each bearing pad includes a plate 66 formed complementarily to transverse members 28, 30 and a flat plate 68 secured together by screws 70 and nuts 72.

Preferably, in the type of garment bag shown in FIG. 1, the screws 70 pass through the garment bag and also the adjacent relatively heavy strap anchor 74 to which the strap 16 is secured. This not only provides a firm base for the bearing pads but additional securement for said anchors.

As stated above the upper frame 20 is preferably formed from a unitary length of rod. To this end, the terminal portions 78, 80 of the rod of frame 20 may be shaped as shown in FIG. 3 so as to interlock with each other. By positioning the interlocking portions within one bearing pad 64 there is no danger of said terminal portions coming apart. The transverse member 30 of lower frame 22 may be similarly secured together.

It will be seen that the above described structure not only results in a light weight assembly but that the same is inexpensive and efficient.

If desired, additional fabric loops 84 may be stitched to the bag under the ends of handle 14.

By providing a handle 82 (FIG. 1) at one of the longitudinal side edges of the bag the folded garment bag may be carried by such handle and may be stored generally vertically against a wall with the wheels 46 out of engagement with the supporting surface.

The stiffness provided by the above described light weight frame permits the elimination of some of the four hooks usually used heretofore to hold the two halves 11,12 together. In fact only one hook near the hanging hook 18 is required.

The plate 60 (FIG. 5) not only prevents interference between the bottom of the bag and the wheels 46 but also prevents sagging of lower corner of the bag.

I claim:

1. In combination with a generally rectangular elongated garment bag adapted to be folded on itself along a transverse fold line, a carrier for said bag comprising:

a frame within said bag for stiffening the lower folded portion of said bag, said frame including a pair of elongated side members extending along the longitudinally extending side edges of said bag and a transversely extending central member adjacent the upper end of said lower portion of said bag, a bearing fixedly secured to said bag adjacent said fold line for swingable supporting said central member, said central member being split at a point within said bearing, the lower end wall of said bag being apertured to receive said side members therethrough, said side members being bent to form a pair of horizontally extending terminal portions external of said bag, and a pair of ground wheels rotatably supported on said terminal portions.

2. A carrier according to claim 1 wherein said central member at said split portion is formed to provide interengaging elements for fixedly securing the split portions together.

* * * * *